US011009323B2

(12) United States Patent
Rastegar et al.

(10) Patent No.: US 11,009,323 B2
(45) Date of Patent: May 18, 2021

(54) VERY LOW-POWER ACTUATION DEVICES

(71) Applicants: Jahangir S Rastegar, Stony Brook, NY (US); Jacques Fischer, Sound Beach, NY (US)

(72) Inventors: Jahangir S Rastegar, Stony Brook, NY (US); Jacques Fischer, Sound Beach, NY (US)

(73) Assignee: OMNITEK PARTNERS LLC, Ronkonkoma, NY (US)

( * ) Notice: Subject to any disclaimer, the term of this patent is extended or adjusted under 35 U.S.C. 154(b) by 762 days.

(21) Appl. No.: 15/403,008

(22) Filed: Jan. 10, 2017

(65) Prior Publication Data

US 2017/0146328 A1 May 25, 2017

Related U.S. Application Data

(60) Continuation of application No. 14/975,823, filed on Dec. 20, 2015, now abandoned, which is a division of application No. 13/542,635, filed on Jul. 5, 2012, now Pat. No. 9,228,815.

(60) Provisional application No. 61/504,304, filed on Jul. 4, 2011.

(51) Int. Cl.

| | |
|---|---|
| ***F42B 10/18*** | (2006.01) |
| ***C06D 5/00*** | (2006.01) |
| ***F42B 30/08*** | (2006.01) |
| ***F42B 10/64*** | (2006.01) |

(52) U.S. Cl.

CPC ..... *F42B 10/18* (2013.01); *C06D 5/00* (2013.01); *F42B 10/64* (2013.01); *F42B 30/08* (2013.01)

(58) Field of Classification Search

CPC ..... F42B 10/18; F42B 10/20; F42B 10/60; F42B 10/62; F42B 10/64; F42B 30/08; F42B 30/10; F42B 30/12; C06D 5/00

USPC ..... 244/3.27

See application file for complete search history.

(56) References Cited

U.S. PATENT DOCUMENTS

| | | | | | |
|---|---|---|---|---|---|
| 3,347,492 | A * | 10/1967 | Abramson | F42B 10/20 | 244/3.28 |
| 4,399,962 | A * | 8/1983 | Wedertz | F42B 10/62 | 244/3.23 |
| 4,579,298 | A * | 4/1986 | Thomson | F42B 19/005 | 244/3.21 |
| 4,624,424 | A * | 11/1986 | Pinson | F42B 10/64 | 102/384 |
| 5,139,216 | A * | 8/1992 | Larkin | F42B 10/26 | 244/3.1 |
| 5,708,232 | A * | 1/1998 | Nedderman, Jr. | B63H 25/00 | 114/20.1 |
| 6,364,248 | B1 * | 4/2002 | Spate | F42B 10/62 | 244/3.21 |

(Continued)

*Primary Examiner* — Richard R. Green
*Assistant Examiner* — Brady W Frazier

(57) ABSTRACT

A munition including: a casing having a first portion and the second portion; and an actuator comprising two or more pistons, each of the pistons being connected at a first end to the first portion of the casing and engaged at a second end to the second portion of the casing, each of the pistons being capable of having an extended and retracted position relative to the first and second ends, the retracted position resulting from an activation of each of the two or more pistons; wherein activation of one or more of the two or more pistons moves the first portion relative to the second portion.

6 Claims, 6 Drawing Sheets

(56) References Cited

U.S. PATENT DOCUMENTS

| | | | | |
|---|---|---|---|---|
| 6,467,722 | B1 * | 10/2002 | Berry | F42B 10/62<br>244/3.1 |
| 6,502,786 | B2 * | 1/2003 | Rupert | F42B 10/50<br>244/3.1 |
| 7,775,480 | B2 * | 8/2010 | Schulein | F42B 10/46<br>244/1 N |

* cited by examiner

VERY LOW-POWER ACTUATION DEVICES

CROSS-REFERENCE TO RELATED APPLICATION

This application is a Continuation Application of U.S. application Ser. No. 14/975,823, filed on Dec. 20, 2015, which is a Divisional Application of U.S. application Ser. No. 13/542,635, filed on Jul. 5, 2012, which claims the benefit of U.S. Provisional Application No. 61/504,304 filed on Jul. 4, 2011, the entire contents of each of which is incorporated herein by reference.

BACKGROUND

Field

The present invention relates generally to very low-power actuation devices and more particularly to very low-power actuation devices for guided gun-fired munitions and mortars that can be scaled to any caliber munitions, including medium and small caliber munitions.

Prior Art

Since the introduction of 155 mm guided artillery projectiles in the 1980's, numerous methods and devices have been developed for actuation of control surfaces for guidance and control of subsonic and supersonic gun launched projectiles. The majority of these devices have been developed based on missile and aircraft technologies, which are in many cases difficult or impractical to implement on gun-fired projectiles and mortars. This is particularly true in the case of actuation devices, where electric motors of various types, including various electric motor designs with or without gearing, voice coil motors or solenoid type actuation devices, have dominated the guidance and control of most guided weaponry.

Unlike missiles, all gun-fired and mortar projectiles are provided with initial kinetic energy through the pressurized gasses inside the barrel and are provided with flight stability through spinning and/or fins. As a result, they do not require in-flight control action for stability and if not provided with trajectory altering control actions, such as those provided with control surfaces or thrusters, they would simply follow a ballistic trajectory. This is still true if other means such as electromagnetic forces are used to accelerate the projectile during the launch or if the projectile is equipped with range extending rockets. As a result, unlike missiles, control inputs for guidance and control is required only later during the flight as the projectile approaches the target.

In recent years, alternative methods of actuation for flight trajectory correction have been explored, some using smart (active) materials such as piezoelectric ceramics, active polymers, electrostrictive materials, magnetostrictive materials or shape memory alloys, and others using various devices developed based on micro-electro-mechanical (MEMS) and fluidics technologies. In general, the available smart (active) materials such as piezoelectric ceramics, electrostrictive materials and magnetostrictive materials (including various inch-worm designs and ultrasound type motors) need to increase their strain capability by at least an order of magnitude to become potential candidates for actuator applications for guidance and control, particularly for gun-fired munitions and mortars. In addition, even if the strain rate problems of currently available active materials are solved, their application to gun-fired projectiles and mortars will be very limited due to their very high electrical energy requirements and the volume of the required electrical and electronics gear. Shape memory alloys have good strain characteristics but their dynamic response characteristics (bandwidth) and constitutive behaviour need significant improvement before becoming a viable candidate for actuation devices in general and for munitions in particular.

The currently available actuation devices based on electrical motors of various types, including electrical motors, voice coil motors and solenoids, with or without different gearing or other mechanical mechanisms that are used to amplify motion or force (torque), and the aforementioned recently developed novel methods and devices (based on active materials, such as piezoelectric elements, including various inch-worm type and ultrasound type motors), or those known to be under development for guidance and control of airborne vehicles, such as missiles, have not been shown to be suitable for gun-fired projectiles and mortars. This has generally been the case since almost all available actuation devices that are being used or are considered for use for the actuation of control surfaces suffer from one or more of the following major shortcomings for application in gun-fired projectiles and mortars:

1. High power requirement for electrical motors and solenoids of different types (irrespective of the mechanical mechanisms that are used to transmit force/torque to the control surfaces), as well as for actuators based on active materials, such as piezoelectric materials and electrostrictive materials and magnetostrictive materials (including various inch-worm designs and ultrasound type motors) and shape memory based actuator designs.
2. Limited dynamic response, i.e., limited peak force or torque and limited actuation speed at full load (equivalent to "bandwidth" in linear control systems), considering the dynamics characteristics of gun-fired projectiles and mortars.
3. Electrical motors of different types and solenoid type actuation devices occupy large volumes in munitions. The volume requirement also makes such electrical actuation devices impractical for medium to small caliber munitions applications.
4. Survivability problems of many of the existing actuation devices at very high setback accelerations of over 50 KG.
5. Reliability of operation post firing, particularly at very high setback accelerations of over 50 KG.
6. The high cost of the existing technologies, which results in very high-cost rounds, thereby making them impractical for large-scale fielding.
7. Relative technical complexity of their implementation in gun-fired projectiles and mortars for control surface actuation.

SUMMARY

Three classes of actuation devices are disclosed herein. The first class of actuation devices provide a nearly continuous actuation motion to the intended control surface. The second class of actuation devices are for applications in which bang-bang control strategy is warranted, such as for munitions with very short flight time or for applications in which the actuation devices with a limited number of actuation actions are used mainly for so-called terminal guidance to the target, i.e., during the last few seconds of flight. The third class corresponds to actuation devices that are used for direct tilting of the projectile nose and which are particularly suitable for small and medium caliber guided munitions.

Such actuators have the following basic characteristics:

1. Provide very low-power control surface actuation devices that can be scaled to any caliber gun-fired munitions and mortars; including 155 mm artillery rounds as well as gun-fired projectiles as small as 60 mm and 25 mm medium and small caliber munitions. The power requirement for the proposed actuation devices is shown to be orders of magnitude less than electrical motor-based actuation devices; reducing electrical energy requirement from KJ to mJ, i.e., less than a fraction of 1% of the electrical energy required by electric motors and solenoid type devices.
2. Unlike actuation devices based on electrical motors of various types, including voice coil motors and solenoids, the actuation devices disclosed herein are very low-volume and are powered with high-energy gas-generating energetic material, thereby requiring a significantly reduced volume for power source (battery, capacitor, etc.).
3. In addition to proving very low-power and low-volume control surface actuation solution for munitions, the actuator devices disclosed herein also address other shortcomings of currently used actuation devices, including: 1) the limited dynamic response; 2) survivability under very high setback accelerations of over 50 KGs; 3) limitations in scalability to different caliber munitions; and 4) being costly to implement.
4. The actuator devices disclosed herein can be readily designed to produce forces of 100-2000 N or higher and torques of 1-10 N-m and higher, and for actuation via charge detonation with fast acting initiation devices, to generate peak force and torque well within 1-10 msec, thereby providing very high dynamic response characteristics.
5. The actuator devices disclosed herein may be integrated into the structure of the projectile as load bearing structures, thereby significantly reducing the amount of volume that is occupied by such actuation devices.
6. Due to their integration into the structure of the projectile and their design, the actuator devices disclosed herein can be readily hardened to survive very high-g firing loads, very harsh environment of firing, and withstand high vibration, impact and repeated loads. The actuator devices disclosed herein result in highly reliable actuation devices for gun-fired projectiles and mortars.
7. The actuator devices disclosed herein can be very simple in design, and can be constructed with very few moving parts and no ball/roller bearings or other similar joints, thereby making them highly reliable even following very long storage times of over 20 years.
8. The actuator devices disclosed herein can be designed to conform to any geometrical shape of the structure of the projectile and the available space within the projectile housing.
9. The actuator devices disclosed herein can be very simple in design and utilize existing manufacturing processes and components. As a result, the such actuation devices provide the means to develop highly effective but low cost guidance and control systems for guided gun-fired projectiles and mortars.
10. The actuator devices disclosed herein can be used in both subsonic and supersonic projectiles.
11. By significantly reducing the power requirement, in certain applications, particularly in small and medium caliber munitions, it is possible to use onboard energy harvesting power sources and thereby totally eliminate the need for onboard chemical batteries. As a result, safety and shelf life of the projectile is also significantly increased.

The aforementioned actuator devices disclosed herein provide very low power, low cost, and highly effective solution options for the full range of gun-fired and mortar munitions, including medium and small caliber munitions.

A need therefore exists for low-cost actuator devices that address the aforementioned limitations of currently available control surface actuation devices in a manner that leaves sufficient volume inside munitions for sensors, guidance and control, and communications electronics and fusing, as well as the explosive payload to satisfy the lethality requirements of the munitions.

Such control surface actuation devices must consider the relatively short flight duration for most gun-fired projectiles and mortar rounds, which leaves a very short period of time within which trajectory correction/modification has to be executed. This means that such actuation devices must provide relatively large forces/torques and have very high dynamic response characteristics ("bandwidth").

The control surface actuation device applications may be divided into two relatively distinct categories. Firstly, control surface actuation devices for munitions with relatively long flight time and in which the guidance and control action is required over relatively longer time periods. These include munitions in which trajectory correction/modification maneuvers are performed during a considerable amount of flight time as well as within a relatively short distance from the target, i.e., for terminal guidance. In many such applications, a more or less continuous control surface actuation may be required. Secondly, control surface actuation devices for munitions in which the guidance and control action is required only within a relatively short distance to the target, i.e., only for terminal guidance purposes.

Such actuation devices must also consider problems related to hardening of their various components for survivability at high firing accelerations and the harsh firing environment. Reliability is also of much concern since the rounds need to have a shelf life of up to 20 years and could generally be stored at temperatures in the range of −65 to 165 degrees F.

In addition, for years, munitions developers have struggled with the placement of components, such as sensors, processors, actuation devices, communications elements and the like within a munitions housing and providing physical interconnections between such components. This task has become even more difficult with the increasing requirement of making gun-fired munitions and mortars smarter and capable of being guided to their stationary and moving targets. It is, therefore, extremely important for all guidance and control actuation devices, their electronics and power sources not to significantly add to the existing problems of integration into the limited projectile volume.

The three classes of control surface actuation devices can be used for actuation of various types of control surfaces, whether they require rotary or linear actuation motions, such as fins and canards or the like. Two classes of the actuation devices disclosed herein are particularly suited for providing high force/torque at high speeds for bang-bang feedback guidance and control of munitions with a very high dynamic response characteristic. As a result, the guidance and control system of a projectile equipped with such control surface actuation devices is capable of achieving significantly enhanced precision for both stationary and moving targets.

The actuator devices disclosed herein occupy minimal volume since they are powered by the detonation of gas generating charges to generate pressurized gas for pneumatic operation of the actuating devices (the first class of actuation devices) or by detonation of a number of gas generating charges embedded in the actuation device "cylinders" to provide for the desired number of control surface actuation (the second class of actuation devices). As a result, the second class of control surface actuation devices can provide a limited number (e.g., 20-50) of control surface actuations, but with actuating forces/torques of order of magnitude larger than those possible by current electrical and pneumatic systems. With such control surface actuation technology, since solid gas generating charges have energy densities that are orders of magnitude higher than the best available batteries, a significant total volume savings is also obtained by the elimination of batteries that are required to power electrically powered actuation devices. It is also noted that the gas generating charges of the actuator devices disclosed herein are intended to be electrically initiated, but such initiation devices utilize less than 3 mJ of electrical energy (other electrical initiators that utilize only tens of micro-J of energy can also be used). The first class of actuation devices also require electrical energy for the operation of their pneumatic valves, but such small solenoid operated valves are also available that require small amounts of energy to operate, such as around 3 mJ.

The control surface actuation devices disclosed herein are also capable of being embedded into the structure of the projectile, mostly as load bearing structural components, thereby occupying minimal projectile volume. In addition, such actuation devices and their related components are better protected against high firing acceleration loads, vibration, impact loading, repeated loading and acceleration and deceleration cycles that can be experienced during transportation and loading operations.

Three classes of control surface actuation devices, their basic characteristics, modes of operation, and method of manufacture and integration into the structure of projectiles are described below. Such control surface actuation devices can provide very low power, very low cost, high actuation force/torque and fast response (high dynamic response) actuation devices that occupy very small useful projectile volume. Furthermore, such control surface actuation devices can readily be scaled to any munitions application, including medium to small caliber munitions. In addition, due to their basic design and since they can be integrated into the structure of munitions as load bearing elements, they can be designed to withstand very high-G firing setback accelerations of well over 50 KG. The actuation devices disclosed herein can also be configured as modular units and thereby provide the basis for developing common actuation solutions to a wide range of gun-fired projectiles and mortars for actuating control surfaces. munition comprising:

Accordingly, a munition is provided. The munitions comprising: a control surface actuation device comprising: an actuator comprising two or more pistons, each of the pistons being movable between an extended and retracted position, the retracted position resulting from an activation of each of the two or more pistons; and a movable rack having a portion engageable with a portion of the two or more pistons to sequentially move the rack upon activation of each of the two or more pistons; and a control surface operatively connected to the rack such that movement of the rack moves the control surface.

The actuator can comprise three pistons.

The actuator can comprise: a housing for movably housing each of the two or more pistons; a plurality of gas generation charges generating a gas in fluid communication with the housing; and an exhaust port for exhausting gas from the housing generated by the plurality of gas generation charges; wherein activation of each of the plurality of gas generation charges results in an increase in pressure in the housing causing the piston to move in the housing from the retracted to the extended position. The actuator can further comprise a gas reservoir, wherein the plurality of gas generation charges are disposed in the gas reservoir, the gas reservoir being in fluid communication with the housing. The actuator can further comprise a valve for directing gas generated in the reservoir to a respective housing. The plurality of gas generation charges can be disposed in the housing. The actuator further can comprise a return spring for biasing each of the two or more pistons in the retracted position.

The portion of the rack can be a plurality of spaced portions and the portion of the piston is an end portion of the piston exposed when the piston is in the extended position. The plurality of spaced portions on the rack can be one of convex or concave portions and the end portion is the other of the convex or concave portions. The convex and concave portions can be conical.

The movable rack can be linear and move linearly. The movable rack can be curved and move around a central axis. The movable rack can rotate.

The control surface can be one or more canards.

The munition can further comprise a casing, wherein the actuator is integral with a structure of the casing.

The rack can be operatively connected to the control surface by a mechanism to convert movement of the rack to a corresponding movement of the control surface. The mechanism can be a pinion.

The rack can be operatively connected to the control surface directly wherein movement of the rack directly corresponds to movement of the control surface.

The housing can be a cylinder.

Also provided is a munition comprising: a casing having a first portion and the second portion; an actuator comprising two or more pistons, each of the pistons being connected at a first end to the first portion of the casing and engaged at a second end to the second portion of the casing, each of the pistons being capable of having an extended and retracted position relative to the first and second ends, the retracted position resulting from an activation of each of the two or more pistons; wherein activation of one or more of the two or more pistons moves the first portion relative to the second portion.

The first portion can be a cylindrical portion of the casing and the second portion can be a nose portion of the casing.

The engagement at the second end can be a rotatable connection.

The nose portion can be rotatably connected to the cylindrical portion and the engagement at the second end can be a contact of the second end with the nose portion.

The connection at the first end can comprise the two or more pistons being housed in a housing associated with the first portion. The housing can be integral with the first portion.

Still further provided is an actuator comprising: a housing; a piston movably disposed in the housing, the piston being movable between an extended and retracted position; a plurality of gas generation charges generating a gas in fluid communication with the housing; and an exhaust port for exhausting gas from the cylinder generated by the plurality of gas generation charges; wherein activation of each of the plurality of gas generation charges results in an increase in pressure in the housing causing the piston to move in the housing from the retracted to the extended position.

The actuator can further comprise a return spring for biasing the piston in the retracted position.

The plurality of gas generation charges can be disposed in the housing.

BRIEF DESCRIPTION OF THE DRAWINGS

These and other features, aspects, and advantages of the apparatus and methods of the present invention will become better understood with regard to the following description, appended claims, and accompanying drawings where:

DETAILED DESCRIPTION

Figure 1:
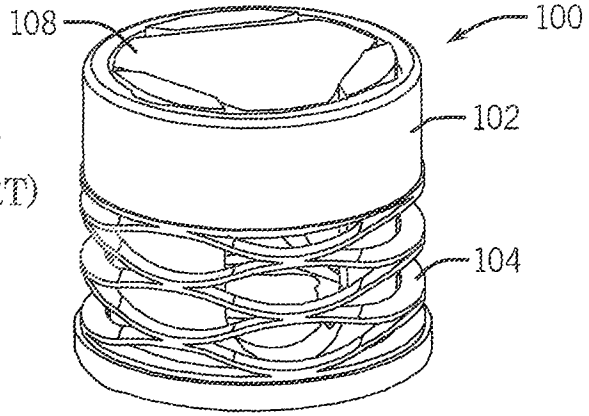
FIG. 1 (PRIOR ART)
FIG. 1 illustrates an isometric view of a miniature inertial igniter.
Figure 2B:
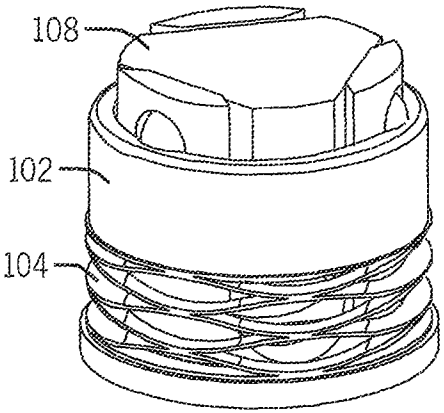
FIG. 2b (PRIOR ART)
FIGS. 2*a-c* illustrate the miniature inertial igniter of FIG. 1 in different phases of an all-fire acceleration event.
Figure 2C:
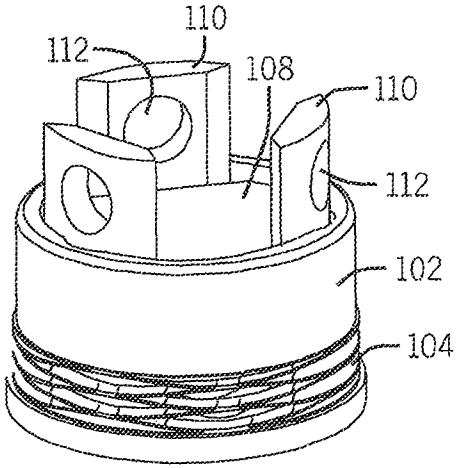
FIG. 2c (PRIOR ART)
Figure 2A:
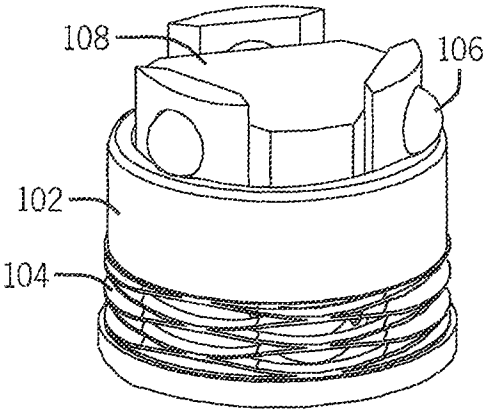
FIG. 2a (PRIOR ART)

A known miniature inertial igniter 100 is shown in FIGS. 1 and 2*a-c*. Such miniature inertial igniters are disclosed in U.S. Pat. No. 7,832,335 and U.S. Patent Publication No. 2011/0171511, the disclosures of which are incorporated herein by reference. Briefly, it consists of a setback collar 102 that is supported by a setback spring 104. The setback collar 102 is biased upward, thereby preventing the setback locking balls 106 from releasing the striker mass 108. The setback collar 102 is provided with deep enough upper guides 110 to allow a certain amount of downward motion before the setback locking balls 106 could be released from their holes 112 (FIG. 2*a*). The spring rate of the setback spring 104, the mass of the setback collar 102 and the height of the aforementioned upper guide of the setback collar 102 determines the level of no-fire G level and duration that can be achieved. Under all-fire condition, the setback collar 102 moves down, (FIG. 2*b*), thereby releasing the setback locking balls 106 which secure the striker mass 108, allowing them to move outward, thereby releasing the striker mass 108. The striker mass 108 is then free to move under the influence of the remaining acceleration event toward its target (FIG. 2*c*), in this case a pyrotechnic material (lead styphnate). Such inertial igniter has been tested in the laboratory for model validation and performance tested in centrifuge, drop tests, and in an air gun for performance and reliability and is currently being produced for a number of munitions.

Figure 3:
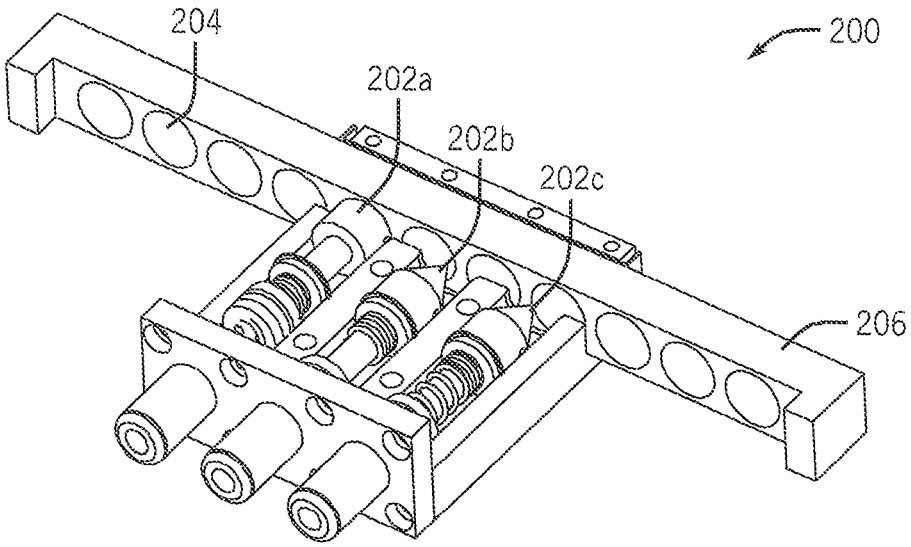
FIG. 3 (PRIOR ART)
FIG. 3 illustrates an isometric view of a pneumatic linear type actuator.
Figure 4:
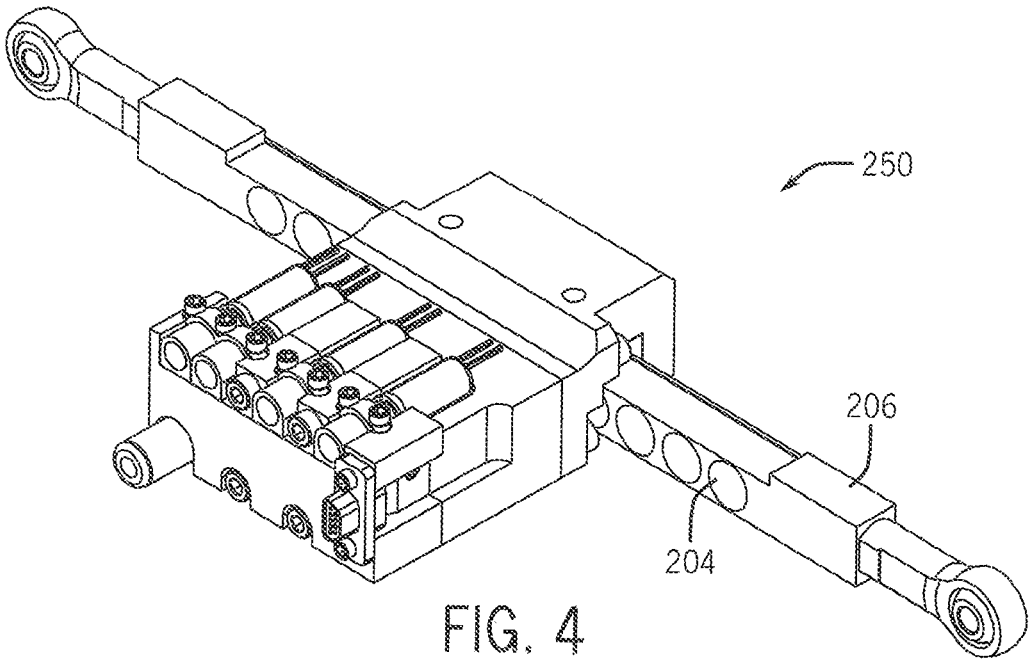
FIG. 4 (PRIOR ART)
FIG. 4 illustrates an isometric view of a prototype of the pneumatic linear type actuator of FIG. 3.

A "mechanical stepper motor" that operates pneumatically, and can apply large actuation forces/torques has also been developed, as shown in U.S. Pat. No. 8,110,785, the disclosure of which is incorporated herein by reference. Such actuation devices use very small electrical energy for their operation. The operation of this novel class of mechanical stepper motor type actuators is based on the principles of operation of simple Verniers. They use pneumatically actuated three or more pistons to achieve step-wise linear or rotary motion of the actuation device. A cutaway view of a pneumatic linear type of such an actuator 200 is shown in FIG. 3. The three pistons 202*a-c* and the pockets 204 on the shuttle 206 are positioned equally distanced apart, with the distance between the pistons 202*a-c* being a certain amount larger than those between the pockets 204. As a result, by driving the pistons 202*a-c* into the pockets 204 sequentially and with a proper sequence, the shuttle 206 can be driven to the right or to the left, each time a third of the distance between two pockets 204. An illustration of a prototype of a linear version of such actuator 250 is shown in FIG. 4.

Figure 5:
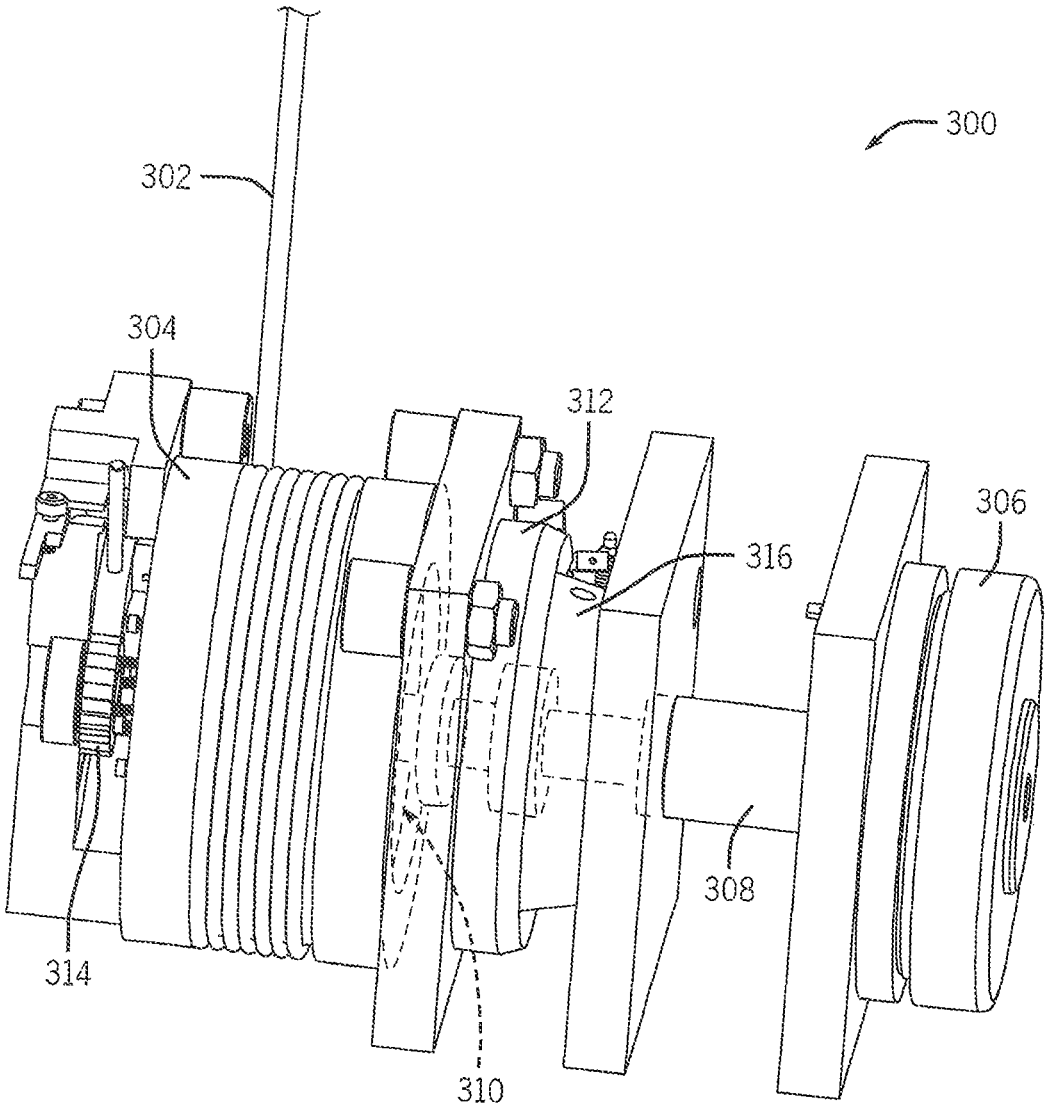
FIG. 5 (PRIOR ART)
FIG. 5 illustrates a isometric view of a dynamo based lanyard-driven electrical power generator.

A lanyard-driven electrical power generator has also been developed for gravity dropped weapons that can overcome a number of shortcomings of the currently available devices such as problems with very high and very low altitude drops, while providing drop and a number of other event detection capabilities used for "safe" and "arm" (S&A) functionalities. Such lanyard-driven electrical power generator is disclosed in U.S. patent application Ser. No. 12/983,301, the disclosure of which is incorporated herein by reference. As shown in FIG. 5, such generators 300 can be constructed by connecting the weapon-end of the lanyard 302 to a multi-wrap drum 304 which is the input by way of a coupling 308 to a rotary generator 306 mounted within the weapon. For safety and performance, several novel mechanisms are employed between the lanyard pulling and the electrical generator.

To provide for safety, when the weapon is mounted on the aircraft, there is no energy stored in a spiral power spring 310, and the shaft of the generator 306 is locked in position, through a flywheel 312, preventing any power generation. When the weapon is released, the lanyard 302 unwinds from the input drum 304, winding and storing energy in the power spring 310. When the lanyard 302 has uncoiled a predetermined length, the lanyard breaks away from the aircraft and descends with the weapon. Just before the lanyard breaks-away, it actuates the locking mechanism which was heretofore holding the flywheel 312 and rotor of the generator 306 stationary, and the power spring 310 transfers its stored mechanical potential energy to the generator (as input rotation) 306. A ratchet mechanism 314 on the cable drum 304 prevents reaction-motion of the cable drum 304, and a one-way clutch 316 allows the flywheel 312 and generator 306 to spin freely after the power spring 310 has unwound completely.

The dynamo-type generator of FIG. 5 may be scaled to satisfy different size and volume and requirements. The torsional spring of the power source may be pre-wound and released by the actuation of a lever or via detonation of a small charge. In addition, impulse generating charges may be used for winding the power spring or for directly causing the device flywheel to gain and sustain kinetic energy to generate the required amount of electrical energy.

Turning now to control surface actuator devices in detail. Two classes of such actuation devices are first discussed. The first class of actuation devices would provide a nearly continuous actuation motion to the intended control surface. The second class of actuation devices are intended for applications in which bang-bang control strategy is warranted, such as for munitions with very short flight time or for applications in which the actuation devices with a limited number of actuation actions are used mainly for the so-called terminal guidance to the target, i.e., during the last few seconds of the flight. The third class corresponds to the actuation devices that provide a limited number of actuation actions and are used to tilt the projectile nose and which are particularly suitable for small and medium caliber guided munitions.

Figure 6:
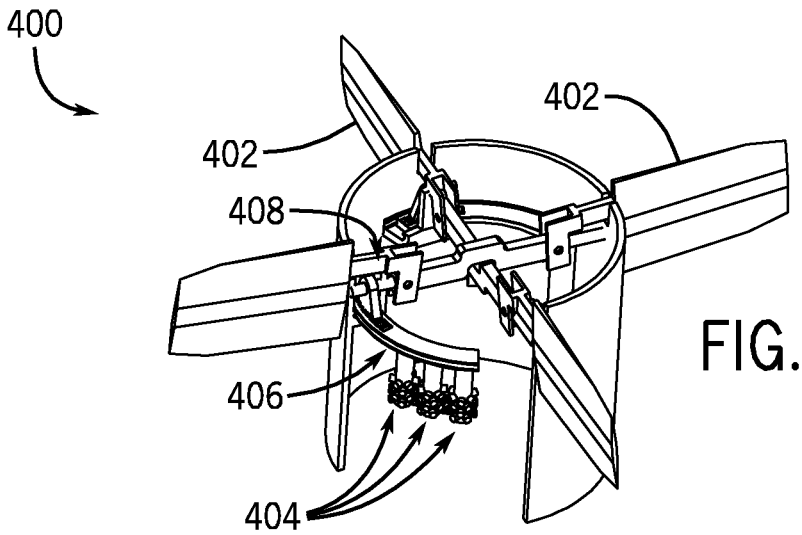
FIG. 6 illustrates a control surface actuator device configured as a canard actuation device.
Figure 7:
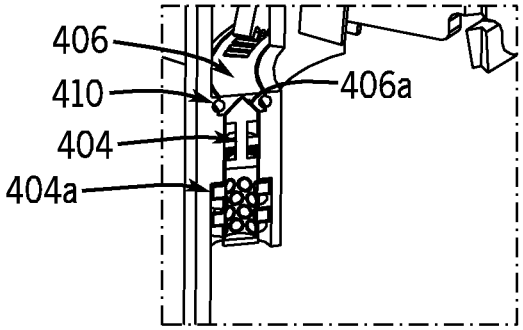
FIG. 7 illustrates a cutaway view of one actuation piston and rotating rack of the motion transmitting rack-and-pinion mechanism of the canard actuation device of FIG. 6.

Structurally Integrated Control Surface Actuators with Limited Actuation Actions The control surface actuator devices discussed with regard to FIGS. 6-8 belong to the aforementioned second class of actuation devices. By way of example, a canard actuation device, as integrated into the structure of a 120 mm round, is shown in FIG. 6. A cutaway view of one actuation piston and the rotating rack of the motion transmitting rack-and-pinion mechanism of the canard actuation device of FIG. 6 is shown in FIG. 7.

Figure 8A:
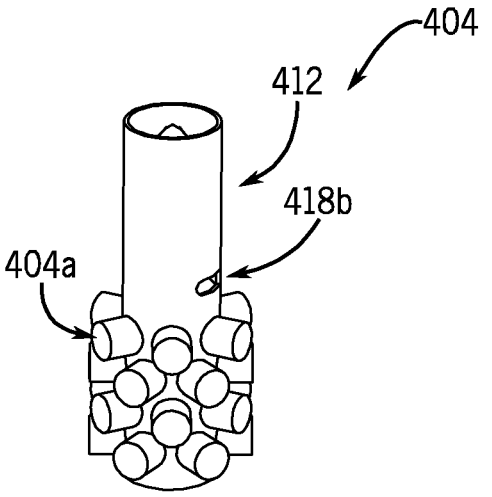
FIG. 8*a-c* illustrate a piston from the control surface actuator device of FIG. 6, FIG. 8*a* illustrating an isometric view of the piston, FIG. 8*b* illustrating a sectional view of the piston in a retracted position and FIG. 8*c* illustrating a sectional view of the piston in an extended position.
Figure 8B:
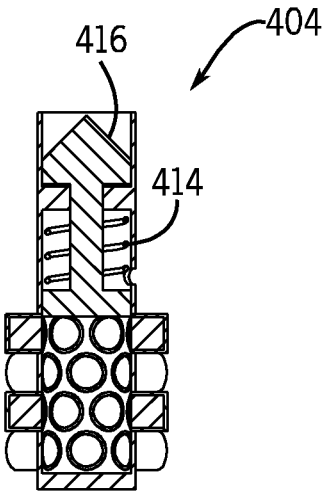
Figure 8C:
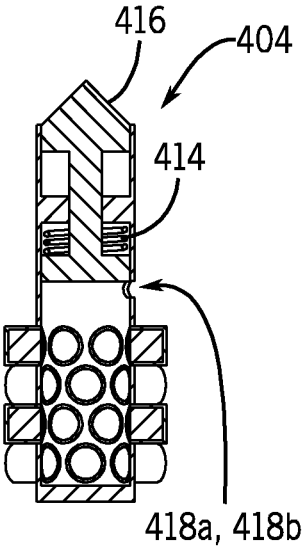

The canard actuation device 400 is based on the aforementioned mechanical stepper motor design discussed above with regard to FIGS. 3 and 4. Two pairs of deployable canards 402, each using a 3-piston actuator 404 with in-cylinder gas generation charges are employed for each pair of in-line canards 402 to achieve independent actuation. Close-up views of one of the pistons 404 are shown in FIGS. 8*a*-*c*. The mechanical stepper motor progressively imparts motion on the actuator rack 406, and may be driven forward or backward in incremental steps on a ball bearing guide 410, as commanded. The actuator rack 406 includes pockets 406*a* and is connected to the deployable canards through a canard pinion 408 which translates actuator rack motion into canard pitching, such pinions being well known in the art (such as the rack and pinion 506 shown in FIG. 10). Each of the three structurally integrated pistons 404 are movably housed in a cylinder housing 412 (or in a bore in the munition structure) and biased in a retracted position within the cylinder housing 412 by a return spring 414, as shown in FIGS. 8*a* and 8*b*. A tip portion 416 of the pistons 404, as shown in FIG. 8*c*, are configured to fit within the pockets 406*a*, such as by being configured into a conical shape. Each of the pistons 404 employs a plurality of discrete gas generation charges 404*a*, as shown in FIGS. 8*a*-8*c*. Upon the ignition (e.g., electrical) of a charge, the generated gas will cause the pressure inside the cylinder to increase and will propel the piston 404 to the extended position against the biasing force of the return spring 414, as shown in FIG. 8*c*. As the piston 404 reaches the limit of its travel, the tip portion 416 engages with a pocket 406*a*, thereby imparting an incremental position change to the rack 406. After such engagement (when the piston 404 reached the limit of its travel), an exhaust port 418*a* in the piston 404 is aligned with an exhaust port 418*b* on the cylinder 412, thereby venting the cylinder pressure and allowing the return spring 414 to drive the piston from the extended position shown in FIG. 8*c* to the retracted position, as shown in FIGS. 8*a* and 8*b*. If automatic cylinder venting is not desired, an exhaust valve to vent the cylinder pressure upon command from the control system can be utilized. Thus, by sequential initiation of charges 404*a* on the three pistons 404, the rack 406 can be moved incrementally to in turn control the canards 402.

It is noted that the aforementioned charges can be initiated electrically by a guidance and control system. Assuming that the canards 402 operate at an upper speed of 20-30 steps per seconds each, for a nominal required initiation electrical energy of 3 mJ, the required electrical energy per second for both canards 402 working at the same time will be 120-180 mJ, i.e., a power requirement of 120-180 mW. Development of electrical initiators that require at most 50 micro-J and are extremely fast acting, would further reduce the required electrical energy to a maximum of 2-3 mJ.

Figure 9:
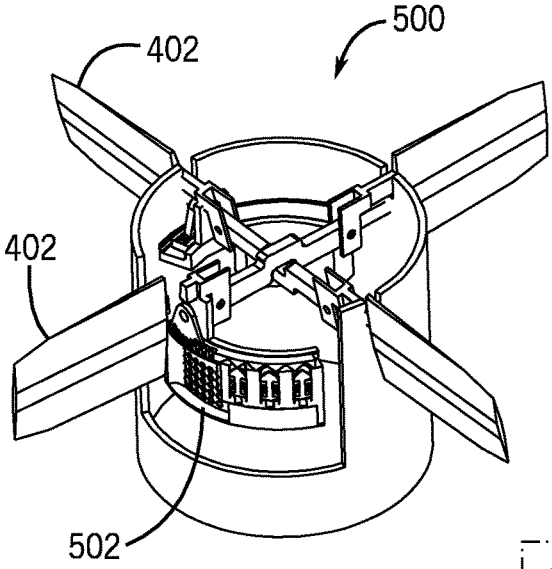
FIG. 9 illustrates an isometric view of an aft end of a projectile having a control surface actuator device.
Figure 10:
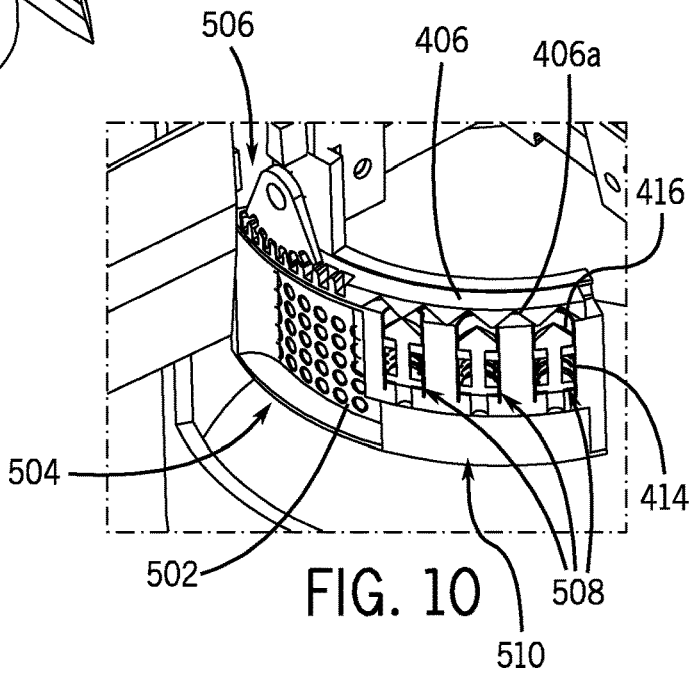
FIG. 10 illustrates a close up outside view of the control surface actuator of FIG. 9.
Figure 11:
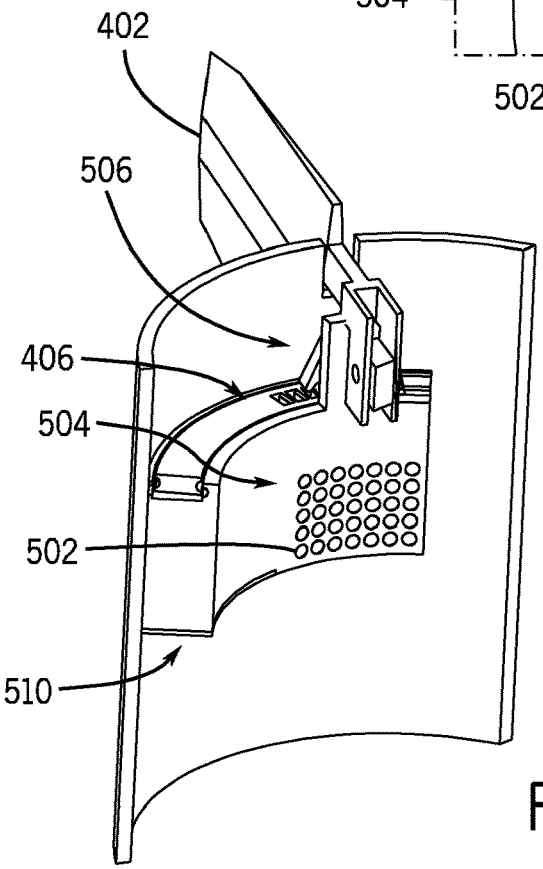
FIG. 11 illustrates a close up inside view of the control surface actuator of FIG. 9.

Structurally Integrated Control Surface Actuators for Continuous Actuation Action The control surface actuator devices discussed with regard to FIGS. 9-11 belong to the aforementioned first class of actuation devices are presented. As an example, the integration of the device is also illustrated for a canard, as shown in FIG. 9. Two cutaway views are presented, one showing an outside view (FIG. 10) illustrating the actuation pistons and motion transmitting rack-and-pinion mechanism of the canard, and the other showing the inside view of the canard actuation device (FIG. 11).

FIGS. 9 and 10 show a similarly structurally-integrated canard actuator 500, but instead of in-cylinder gas generation, an array of discrete gas generating charges 502 is located in an adjacent reservoir 504. The individual structurally-integrated actuator pistons 508 are then controlled through a valve body 510 which uses the pressure from the reservoir 504 to drive the pistons 508. Pressure may be developed in the reservoir 504 shortly before anticipated actuation, and then maintained automatically by igniting successive gas generation charges to ensure that pressure to actuate the canards 402 is always available. The canard actuator 500 may be configured with a reservoir for each actuator piston group 508 (as shown), or with a single reservoir to feed multiple piston groups 508 on a single projectile. The ability to employ any number of reservoirs of varying geometry and location may allow for more seamless integration of the complete actuator system into a given munitions.

Similarly to the canard actuator of FIGS. 6, 7 and 8*a*-8*c*, pressure from the gas generating charges extends the piston 508 to force its tip 416 into a pocket 406*a* on the rack 406 against the biasing force of the return spring 414. When the pressure is exhausted, the tip 416 retracts from the pocket 406*a*. In this way, the rack 406 can be moved incrementally to in turn control the canards 402 though pinion 506.

Five-Position Control Surface Actuation Devices

Figure 12:
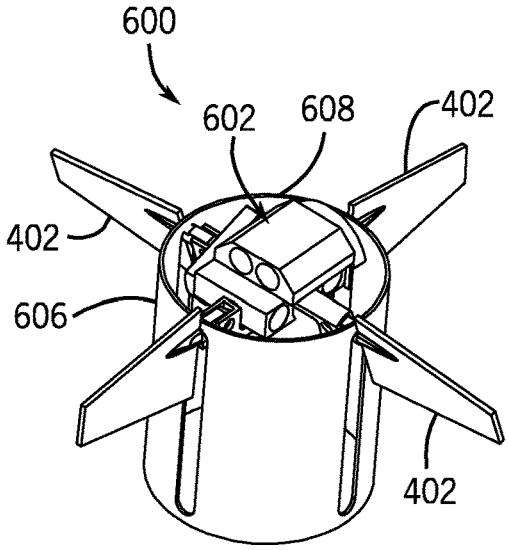
FIG. 12 illustrates an isometric view of an aft end of a projectile having a control surface actuator device.
Figure 13:
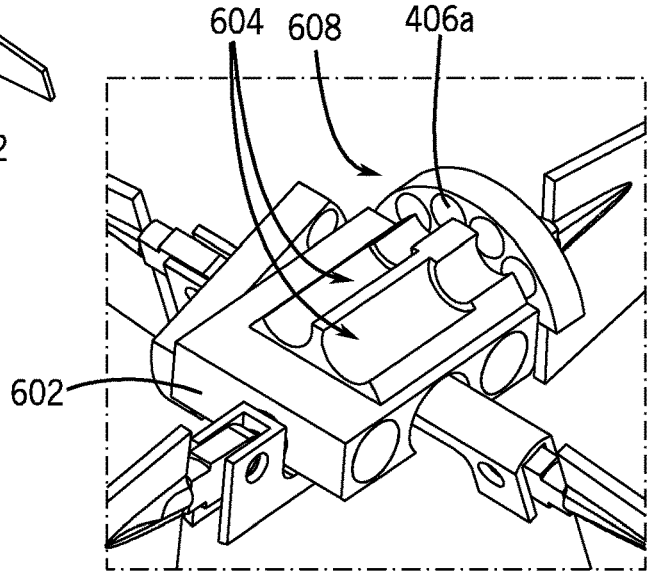
FIG. 13 illustrates a partial close up view of the control surface actuator device of FIG. 12.

The control surface actuator discussed with regard to FIGS. 12 and 13 belong to either of the aforementioned first or second classes of control surface actuation concepts. This configuration provides much simpler and compact control surface actuation devices that are particularly suitable to implement a bang-bang control strategy, such as for munitions with very short flight time or for applications in which the actuation devices are used mainly for the so-called terminal guidance to the target, i.e., during the last few seconds of the flight.

The control surface actuator 600 discussed with regard to FIGS. 12 and 13, requires only two actuation pistons (not shown, but of similar configuration shown above with regard to FIGS. 7-11) for operation. The canards 402 are held in a neutral position by a spring mechanism (not shown) which will hold them in place against aerodynamic forces. The actuator 600 is designed such that depending on the sequence of the two actuation piston operation, the canard 402 is rotated on opposite directions. As a result, two successive positions to either side of the neutral position would provide for a total of five positions of the control surface. These four non-neutral positions may be commanded on multiple occasions and repeated as desired.

Specifically, an actuator body 602 having cylinders 604 for holding the piston actuators (not shown) is provided on an aft end of the projectile body 606 for each of the canard pairs 402. Each of the canard pairs 402 are rotatable and include at least a partial disc 608 having pockets 406*a*. The pistons (not shown) include the tip portion 416 that is extendable into the pockets 406*a* upon activation of the piston or retractable therefrom by a return spring 414. In this way, the disc 608 can be moved incrementally to directly turn the canards 402.

Additionally, this particular embodiment of the 2-piston design employs transverse pistons as opposed to the axially positioned pistons previously discussed. This piston arrangement allows for the elimination of the pinion gearing, and may have advantages over the axial piston arrangement with respect to possible setback/setfoward effects on the pistons. Such a transverse piston arrangement could also be implemented on other previously described designs.

Structurally-Integrated Projectile Nose Actuation Devices

Figure 14A:
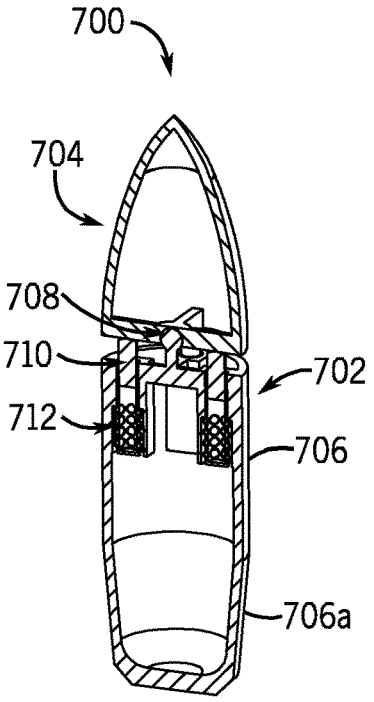
FIGS. 14*a* and 14*b* illustrate a control surface actuation device as implemented in small or medium caliber munitions, with FIG. 14*a* illustrating the nose of the munitions in its neutral (aligned) position and FIG. 14*b* illustrating the nose of the munitions in a tilted position.
Figure 14B:
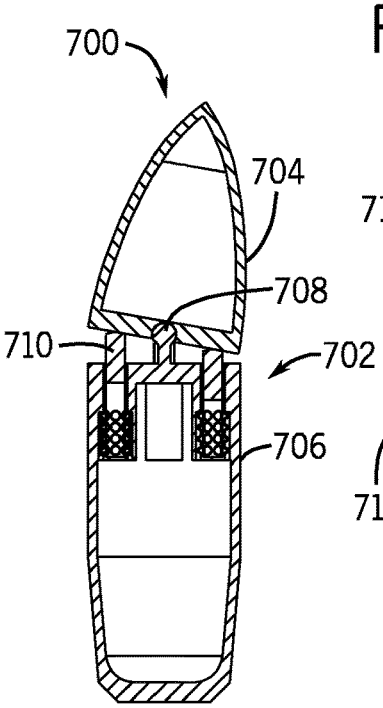
Figure 14C:
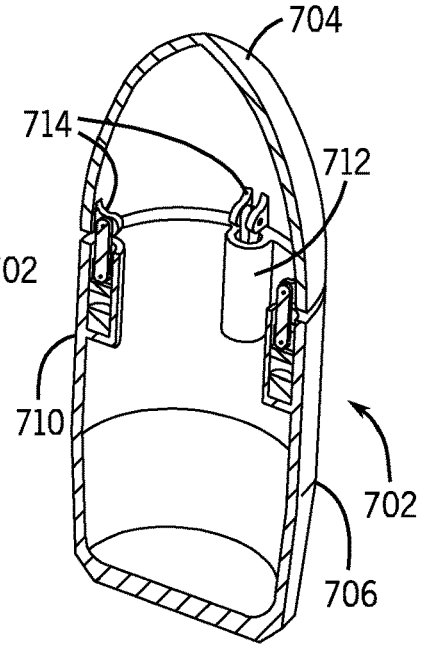
FIG. 14*c* illustrates an interior cut away view of a control surface actuation device as implemented in small or medium caliber munitions.

The control surface actuator discussed with regard to FIGS. 14*a*-14*c* belong to the aforementioned third class of actuation devices, i.e., the actuation devices that are used for direct tilting of the projectile nose. Such control surface actuation devices are particularly suitable for small and medium caliber guided munitions, and for providing a limited number of actuation actions for their bang-bang control. However, the actuators may also be used in larger caliber projectiles and to provide a near continuous control surface actuation by incorporating the gas generator reservoir and control valves described for the first class of actuation devices.

Such control surface actuation device as implemented in small or medium caliber munitions is shown in FIGS. 14*a* and 14*b*, with the nose in its neutral (aligned) position and in tilted position, FIGS. 14*a* and 14*b*, respectively. It is noted that the actuators with different stroke lengths may be used to provide more than one nose tilting angle. In FIG. 14*a*, a munition 700 includes a casing 702 having a nose 704 and cylindrical body 706. The nose 704 is attached to the cylindrical body by a rotating joint, such as a spherical joint 708 such that the nose can be tilted in the direction of the rotating joint, which in the case of the spherical joint 708 is in any direction. Two or more actuator devices 710 similar to those described above with regard to FIG. 8*a*, are fixed along a circumference of an inner surface of the cylindrical body 706. Such actuation devices 710 can be mounted on such inner surface, disposed in a housing 712 integral with the casing wall 706*a* (as shown in FIG. 14*c*) or disposed in a cavity in the casing wall 706*a* itself. Detonation of the gas generation charges results in extension of the piston within the actuator (similar to that shown in FIG. 8*c*) to urge one side of the nose 704 such that the nose 704 becomes titled with respect to a longitudinal axis of the cylindrical body 706 (as shown in FIG. 14*b*). Instead of urging against a surface of the nose, the end of the piston can be rotatably connected to one or more a projections 714 on an interior surface of the nose 702, as shown in FIG. 14*c*.

The control surface actuation device has very high dynamic response characteristics, since it is based on detonations of charges and utilization of the generated high detonation pressures to drive the actuation devices. For example, such a linear control surface actuator operating at a detonation pressure of around 5,000 psi and with a pressure surface of only 0.2 square inches (0.5 inch dia.) would readily provide a force of around 980 lbs or 4,270 N (which can still be significantly magnified via the inclined contact surfaces between the piston and the translating element of the actuator). A rotary actuator with a similar sized pressure area with an effective diameter of 2 inches and operating at 5000 psi could readily produce a torque of over 100 N-m. In addition, reliable detonation within time periods of 1-2 msec and even significantly lower with the aforementioned micro-J initiation devices (being developed jointly with ARL) should be achievable. Thereby, the peak force/torque should be achievable within 1-2 msec or less, providing control surface actuation devices with very high dynamic response characteristics that are ideal for guidance and control of precision gun-fired projectiles of different calibers and mortars.

The mechanical stepper motors and actuators disclosed above actuate by detonating gas charges, and as such, have the capability of generating large actuation forces. Consequently, such mechanical stepper motors will have widespread commercial use in emergency situations that may require a large generated force and where a one-time use may be tolerated. For Example, the mechanical stepper motors and actuators disclosed above can be configured to pry open a car door after an accident to free a trapped passenger or pry open a locked door during a fire to free a trapped occupant.

The novel mechanical stepper motors and actuators disclosed above, being actuated by detonating gas charges, do not require an external power source for actuation, such as hydraulic pumps or air compressors. Accordingly, such mechanical stepper motors can be adapted for use in remote locations where providing external power to the device is troublesome or impossible. For Example, the novel mechanical stepper motors disclosed above can be used under water, such as at the sea floor.

The novel mechanical stepper motors and actuators disclosed above, due to their capability of generating large actuation forces, can also be used for heavy duty industrial applications, such as for opening and closing large valves, pipes, nuts/bolts and the like.

As technology advances and buildings grow taller, oil exploration gets deeper, vehicles get larger and faster and the frontiers of ocean and space expand, the need for emergency, remote and heavy use actuators will grow. The mechanical stepper motors and actuators disclosed above will be vital to the continued advancement of such technologies and continued expansion of such frontiers. Growth in these areas can stagnate or reverse if there is no practical answer to saving people trapped in a vehicle traveling at great speeds, saving people trapped on the 100th floor of a skyscraper, plugging a leak on an oil pipeline 1 mile deep on a sea floor, turning on a large valve at a damaged nuclear power plant or providing the actuators necessary for the colonization of space. For at least these reasons, emergency, heavy and remote actuation devices are expected to be actively pursued for decades. The use of the mechanical stepper motors and actuators disclosed above could provide such improvements.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A munition comprising:

a casing having a first portion and a second portion; and an actuator comprising two or more pistons, each of the two or more pistons being connected at a first end to the first portion of the casing and engaged at a second end to the second portion of the casing, each of the two or more pistons comprising:

a tube;

a shaft movably disposed in the tube between an extended position and a retracted position;

a spring arranged to bias the shaft in the retracted position;

a plurality of detonation charges disposed on the tube, each of the plurality of detonation charges generating gas upon detonation to move the shaft to the extended position; and an exhaust port provided in the tube for exhausting the generated gas such that the shaft is biased back to the retracted position by the spring;

wherein moving the shaft to the extended position moves the second portion relative to the first portion.

2. The munition of claim 1, wherein the first portion is a cylindrical portion of the casing and the second portion is a nose portion of the casing.

3. The munition of claim 2, wherein the engagement at the second end is a rotatable connection.

4. The munition of claim 2, wherein the nose portion is rotatably connected to the cylindrical portion and the engagement at the second end is a contact of the second end with the nose portion.

5. The munition of claim 1, wherein the connection at the first end comprises the two or more pistons being housed in a housing associated with the first portion.

6. The munition of claim 5, wherein the housing is integral with the first portion.

* * * * *